United States Patent [19]

Yuda

[11] 4,369,553

[45] Jan. 25, 1983

[54] BUCKLE

[75] Inventor: Takuo Yuda, Yokohama, Japan

[73] Assignee: Nifco Inc., Yokohama, Japan

[21] Appl. No.: 254,552

[22] Filed: Apr. 13, 1981

[30] Foreign Application Priority Data

Apr. 18, 1980 [JP] Japan ..... 55-51813[U]

[51] Int. Cl.[3] ..... A44B 19/00

[52] U.S. Cl. ..... 24/230 R

[58] Field of Search ..... 24/201 A, 230 R, 230 A, 24/230 AS

[56] References Cited

U.S. PATENT DOCUMENTS

| | | | |
|---|---|---|---|
| 3,200,461 | 8/1965 | Miller | 24/201 A |
| 3,225,406 | 12/1965 | Levy | 24/230 R |
| 3,967,351 | 7/1976 | Rosenberg et al. | 24/201 A |
| 4,015,094 | 3/1977 | Gavagan | 24/230 A |

*Primary Examiner*—Gene Mancene

*Assistant Examiner*—Wenceslao J. Contreras

*Attorney, Agent, or Firm*—Jerold M. Forsberg; Thomas W. Buckman

[57] ABSTRACT

A buckle comprises a receptacle member and an insertion member which are easily united and disunited. The receptacle member includes an engaging portion and a socket of a construction capable of admitting the insertion member. The insertion member includes a central piece, a pair of guide pieces connected to the leading end of the central piece and separated by slits from the upper and lower ends of the central piece, and an complimentary portion which when brought into engagement with the engaging portion of the receptacle member thereby retains the two members in an inextricably united state. The disunion of the two members is easily accomplished by inwardly pressing the portion of the insertion member fastened to the belt end toward the user's abdomen.

4 Claims, 4 Drawing Figures

BUCKLE

BACKGROUND OF THE INVENTION

This invention relates to a buckle for use with a belt fastened on garments, which comprises a receptacle member adapted to be fastened to one end of the belt and an insertion member adapted to be fastened to the other end of the belt and to be separately inserted into the rear portion of the receptacle member.

From early times, most buckles for belts used on garments have been made of metals. They are expensive and take much time and labor to manufacture. Thus, attempts have been made to produce buckles from plastics and other materials easy of forming. The conventional buckles made of these materials, however, have involved a disadvantage that they comprise numerous parts or they are complicated in shape. (U.S. Pat. No. 4,150,464 and Japanese Utility Model Laid-open Publications No. 30001/1978 and No. 110025/1978)

SUMMARY OF THE INVENTION

One object of the present invention is to provide a buckle capable of easy union and disunion of the component parts thereof.

To accomplish the object described above according to this invention, there is provided a buckle which comprises a receptacle member adapted to be fastened to one end of a belt to be used on garments and an insertion member adapted to be fastened to the other end of the belt and to be separably inserted into a socket formed on the rear portion of the aforementioned receptacle member for admitting the insertion member at least through one end of the socket. Partly on the rear surface of the receptacle member and partly on the front surface of the insertion member, there is disposed a composite engaging means which is adapted to enable the receptacle member and the insertion member to be retained inextractibly in fast engagement after the insertion member has been fully fitted into the socket on the rear portion of the receptacle member. The composite engaging means, for example, comprises matched ridges and grooves, which are readily joined to each other by simply fitting the insertion member into the receptacle member. The separation of the ridges and grooves from their fast union is accomplished by inwardly pressing the portion of the insertion member fastened to the belt end toward the user's abdomen.

The other objects and characteristics of the present invention will become apparent from the further disclosure of the invention to be given hereinbelow with reference to the accompanying drawing.

DESCRIPTION OF THE PREFERRED EMBODIMENT

Figure 1:
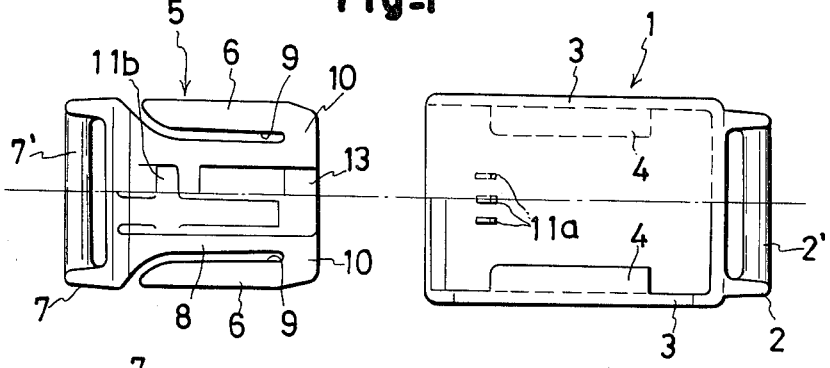
FIG. 1 is a plan view illustrating separately the receptacle member and the insertion member, which are the components of the buckle of this invention, with the front sides of the components appearing in the upper half and the rear sides thereof in the lower half respectively of the diagram.
Figure 2:
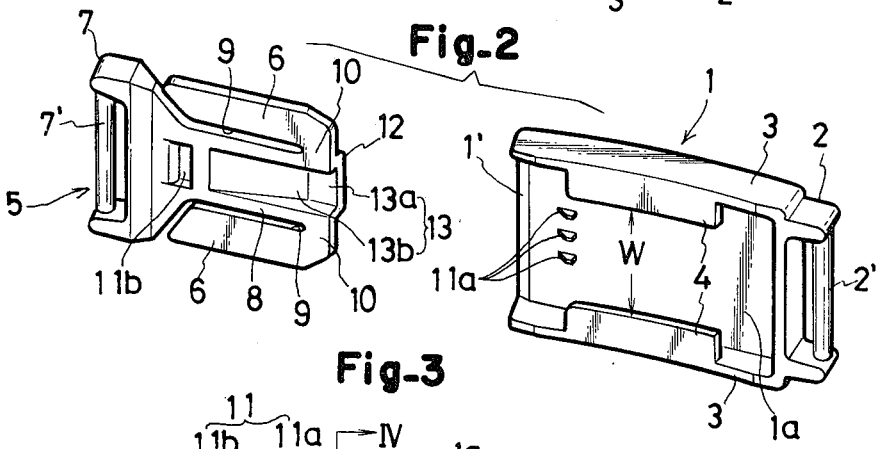
FIG. 2 is a perspective view of the buckle of FIG. 1, with the rear side of the receptacle member and the front side of the insertion member appearing respectively in the diagram.
Figure 3:
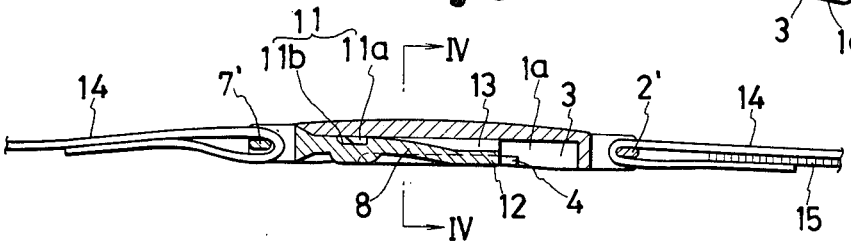
FIG. 3 is a longitudinally sectional view of the buckle of FIG. 1, with the components thereof held in a state of fast union.
Figure 4:
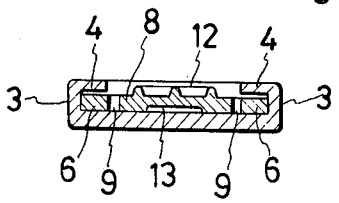
FIG. 4 is a sectional view taken along the line IV—IV indicated in FIG. 3.

Referring to the drawing, the buckle of the present invention comprises a receptacle member 1 and an insertion member 5 adapted to be pushed into the receptacle member for fast union therewith. In the illustrated embodiment, the receptacle member 1 has the shape of an oblong rectangle. It is provided at one end thereof with a belt-fastening portion 2 for fastening one end of a given belt 14. On the upper and lower edges of the receptacle member, opposed side walls 3 rise sideways parallel to each other. From the side walls 3, opposed guide wings 4 are extended over the rear surface of the receptacle member. The distance between the rear surface of the receptacle member and the surfaces of the guide wings 4 opposed thereto is slightly greater than the thickness of the guide pieces 6 forming the upper and lower edges of the insertion member 5. The rear surface of the parallel side walls 3 possessed of these guide wings 4 define a socket 1*a* to be used for admitting the insertion member. The admission of the insertion member 5 into the socket 1*a* is accomplished by causing the guide pieces 6 to enter the socket through the other edge 1' of the receptacle member and slide in between the rear surface of the receptacle member and the guide wings 4. When the receptacle member 1 has an elliptic, circular or some other shape instead of a rectangular shape, therefore, the socket 1*a* for admitting the insertion member may be formed by causing the side walls 3 possessed of the guide wings to be disposed parallelly to each other on the rear surface of the receptacle member.

The insertion member 5 is provided at one end thereof with a belt-fastening portion 7 for fastening the other end of the belt 14. It is also possessed of a central piece 8 which has a width smaller than the distance "W" separating the opposed edges of the guide wings 4 of the receptacle member and which extends from the belt-fastening portion 7 toward the opposite end. The aforementioned guide pieces 6 are disposed parallel above and below the central piece 8, with slits 9 intervening therebetween, and joined through connecting portions 10 to the upper and lower parts of the expanded leading end of the central piece 8. The slits, therefore, open at one end of the insertion member and give rise to the free ends of the guide pieces 6, and they terminate at the connecting portions 10. Since the guide pieces 6 and the central piece 8 continue into each other only through the connecting portions 10, they are allowed to bend in the direction of thickness without being appreciably affected by each other.

At the positions of the front surface of the central piece 8 and the rear surface of the receptacle member which coincide with each other when the insertion member 5 is fully driven into the socket 1*a* of the receptacle member, there is provided a composite engaging means 11 which is adapted so that the component members thereof keep the central piece 8 bent backward during the advance of the insertion member through the socket 1*a* of the receptacle member until they come into snapping engagement with each other on completion of the advance and, once the engagement is established, they retain the state of engagement by offering strong resistance to any external force exerted in the direction of breaking their engagement. In the present embodiment, the composite engaging means 11 comprises a saw-toothed protuberance 11*a* and a hole or recess 11*b* (hereinafter referred to as "recess") adapted to admit the protuberance 11*a*. The protuberance 11*a* is formed on the rear surface of the receptacle member, with the inclined surface thereof directed toward the other end 1'. The recess 11*b* is formed on the front surface of the central piece 8 of the insertion member. The composite engaging means 11 is not limited to the combination of a toothed protuberance and a recess as involved in the present embodiment. It may be formed of two protuberances rising toward each other. The protuberances are not necessarily required to be in a saw-toothed shape. When the composite engaging means is composed of a protuberance and a groove, the protuberance may be formed on the front surface of the insertion member and the recess in the rear surface of the receptacle member contrary to those involved in the present embodiment. In the illustrated embodiment, three protuberances are formed as spaced in the vertical direction of the receptacle member and one recess large enough to admit the three protuberances all at once is formed in the insertion member. Of course, these three protuberances may be replaced by a single ridge of a length equalling the overall length of the three protuberances. Otherwise, there may be provided as many grooves as there are protuberances, so that they admit the protuberances one each.

The receptacle member 1 and the insertion member 5 may be made either of a metal or of plastic. In either case, however, at least the insertion member is required to have suitable flexibility.

When the insertion member 5 is slid through the other end 1' of the receptacle member into the socket 1*a* on the rear surface of the receptacle member until the composite engaging means completes its union, the insertion member is substantially completely contained within the socket 1*a* of the receptacle member, with the belt-fastening portion 7 alone left out. In this state, the insertion member is joined to the receptacle member so fast that it is totally inextractible or hardly extractible. Between the time the insertion is started and the time the insertion member is nearly completely received into the socket and the composite engaging means 11 practically completes its union, the guide pieces 6 of the insertion member advances in the space between the rear surface of the receptacle member and the guide wings 4 and yields to the pressure exerted thereon by the guide wings 4. In the meantime, the central piece 8 in the present embodiment, for example, bends into the space opposite the guide wings 4 under the pressure of the protuberance 11*a* on the rear surface of the receptacle member and, consequently, remains off the rear surface of the receptacle member. As soon as the recess 11*b* is brought directly above the protuberance 11*a*, it snaps into engagement with the protuberance. The sensation caused by this snapping engagement enables the user of the buckle to discern the completion of union. In the present embodiment, the buckle is constructed so that after the insertion member is nearly completely received into the socket of the receptacle member and the composite engaging means 11 practically completes its union, the belt-inserting portion 7 of the insertion member collides with the other end 1' of the receptacle member and is not allowed to advance any more. This restraint to the advance of the insertion member is not an essential requirement.

After the buckle has been united as described above, breakage of the union is accomplished by bending the central piece 8 of the insertion member in the direction departing from the rear surface of the receptacle member and thrusting out of the distance between the guide wings 4 thereby disengaging the component elements of the composite engaging means 11 and, thereafter, extracting the insertion member from the socket 1*a*. This operation can be easily carried through by the user of the buckle holding the belt-inserting portion 7 of the insertion member in one hand and the belt-inserting portion 2 of the receptacle member in the other hand and pressing the belt-inserting portion 7, in the case of a belt fastened on a garment, in the direction of his abdomen. The composite engaging means 11 can be disposed at any desired position falling in the path of the advance of the insertion member into the socket. When the position on the part of the receptacle member is selected near the other end 1' and that on the part of the insertion member is correspondingly selected near the belt-fastening portion 7 of the central piece as in the present embodiment, there ensues an advantage that, during the breakage of union, the central piece 8 need not be bent greatly to be separated from the rear surface of the receptacle member.

When the central piece 8 of the insertion member is given a flat plate-like shape and the recess 11*b* is formed by boring a hole which opens on either side of the central piece, the insertion member acquires identical obverse and reverse surfaces. Thus, the engagement of the receptacle member and the insertion member can be accomplished by opposing either side of the insertion member to the rear surface of the receptacle member.

In the present embodiment, however, the recess 11*b* is formed so as to open only in the rear surface of the central piece 8. In this arrangement, the engagement is not established unless the front surface of the central piece is opposed to the rear surface of the receptacle member. In this case, it is desirable to form a raised portion 12 on the rear surface of the central piece. When the rear surface of the central piece is opposed to the rear surface of the receptacle member through inadvertence prepartory to insertion, the raised portion 12 collides with the rear surface of the receptacle member and consequently prevents the guide pieces 6 from entering the space between the rear surface of the receptacle member and the guide wings 4. The provision of this raised portion 12, therefore, brings about an advantage that otherwise possible erroneous handling of the buckle will be precluded.

When the raised portion 12 thus intended to prevent erroneous handling is formed on the rear surface of the central piece as described above, a groove 13 which opens in the leading end and terminates in the closed end in front of the recess 11*b* may be formed on the front surface of the central piece as illustrated in the drawing. Then, during the advance of the insertion member 5 into the socket 1*a* of the receptacle member, the protuberance 11*a* on the rear surface of the receptacle member is allowed to advance within this groove 13 and the central piece is allowed to maintain intimate contact with the rear surface of the receptacle member until it reaches a certain depth. Only over a small distance following that depth and preceding the point at which the recess 11*b* comes to overlie the protuberance 11*a*, the central piece is caused to depart from the rear surface of the receptacle member. Thus, the insertion can be facilitated. In this case, the bottom of the groove 13 has a flat portion 13*a* over a certain length from the leading end toward the closed end so that the central piece may be inserted without being separated from the rear surface of the receptacle member. Beyond that length, the bottom is made to lose its depth gradually until the closed end to form an inclined portion 13*b*. Thus, during the subsequent insertion, the central piece is allowed to depart gradually from the rear surface of the receptacle member.

The belt-fastening portions 2, 7 can be constructed by crossing bars 2', 7' between the two ear-like projecting pieces as illustrated, so that the belt ends 14 may be passed around the bars 2', 7' and folded back over themselves. Either or both of the ends of the belts which have been passed around the bars 2', 7' and doubled over themselves may be fastened in the folded state with a plane fastener 15. The length of the belt may be adjusted by suitably changing the position at which this plane fastener 15 is fixed to fasten the belt end.

As is clear from the description given above, the buckle of the present invention can be bound simply by inserting the insertion member completely into the receptacle member. The separation of the receptacle member and the insertion member can be easily accomplished by pressing the belt-fastening portion of the insertion member in the direction of the user's abdomen. Since the receptacle member and the insertion member are formed in relatively simple shapes, they can be easily molded of a plastic material.

What is claimed is:

1. A buckle comprising a receptacle member adapted to be fastened to one end of a belt and an insertion member adapted to be fastened to the other end of said belt and brought into separable union with said receptacle member; said receptacle member including a first portion of an engaging means formed on the rear surface of said receptacle member and a socket comprising two vertically opposed side walls formed on the rear surface of said receptacle member and guide wings extended from said side walls toward each other over the rear surface of said receptacle member; said insertion member including a central piece of a width smaller than the distance between said two guide wings and provided on the front surface thereof with another portion of an engaging means and a pair of guide pieces of a thickness small enough for passage between the rear surface of said receptacle member and said guide wings, connected to the leading end of said central piece and separated by intervening slits from the upper and lower ends of said central piece; said insertion member being inserted into said receptacle member through one end of said socket thereby bringing said receptacle member and said insertion member into inextricable engagement by the engagement of said engaging means portions.

2. The buckle according to claim 1, wherein said first portion engaging means formed on the rear surface of said receptacle member is a plurality of protuberances and said another portion of said engaging means formed on the front surface of said central piece of said insertion member is a groove.

3. The buckle according to claim 1 or 2, wherein said central piece of said insertion member is constructed so as to be flexible relative to said pair of guide pieces.

4. The buckle according to claim 3, wherein said central piece of said insertion member is provided on the leading front end thereof with a groove and on the leading rear end thereof with a raised portion.

* * * * *